US006053162A

United States Patent [19]

Godfree et al.

[11] Patent Number: 6,053,162

[45] Date of Patent: Apr. 25, 2000

[54] BALANCED FLUE SEALED VENT TERMINAL ASSEMBLY

[75] Inventors: Jeremy B. Godfree, Pugwash; James J. Johnson, Truro, both of Canada

[73] Assignee: Newmac Mfg. Inc., Nova Scotia, Canada

[21] Appl. No.: 09/182,311

[22] Filed: Oct. 30, 1998

[51] Int. Cl.[7] ..... F24C 3/00; F24C 1/14; F23L 17/02

[52] U.S. Cl. ..... 126/85 B; 126/80; 126/307 R; 126/293; 126/312; 454/36; 454/8

[58] Field of Search ..... 126/85 B, 80, 126/307 R, 307 A, 293, 312; 454/36, 35, 8

[56] References Cited

U.S. PATENT DOCUMENTS

| | | | |
|---|---|---|---|
| 2,966,838 | 1/1961 | Thompson et al. | 126/85 B |
| 2,974,650 | 3/1961 | McCorquodale | 126/85 B |
| 2,998,764 | 9/1961 | Bedell et al. | 126/85 B |
| 3,105,432 | 10/1963 | Chamberlain | 126/85 B |
| 3,192,852 | 7/1965 | Stark et al. | 126/85 B |
| 3,221,730 | 12/1965 | Hughes et al. | 126/85 B |
| 3,428,040 | 2/1969 | Baker et al. | 126/85 B |
| 3,435,816 | 4/1969 | Werth | 126/85 B |
| 3,765,823 | 10/1973 | Kawabata et al. . | |
| 4,206,693 | 6/1980 | Mitchell . | |
| 4,335,648 | 6/1982 | Mitchell . | |
| 4,934,335 | 6/1990 | Marlatt . | |
| 5,261,388 | 11/1993 | Trieb | 126/85 B |
| 5,282,456 | 2/1994 | Smelcer et al. . | |
| 5,309,891 | 5/1994 | Savoie . | |
| 5,392,760 | 2/1995 | Binzer | 126/85 B |
| 5,406,932 | 4/1995 | Joseph et al. . | |
| 5,562,088 | 10/1996 | Valters et al. | 126/85 B |
| 5,680,856 | 10/1997 | van Dijk . | |

FOREIGN PATENT DOCUMENTS

| | | |
|---|---|---|
| 828497 | 12/1969 | Canada . |
| 834504 | 2/1970 | Canada . |
| 1040955 | 10/1978 | Canada . |
| 1121215 | 4/1982 | Canada . |
| DES 57471 | 1/1986 | Canada . |
| DES 55610 | 11/1986 | Canada . |
| 1238541 | 6/1988 | Canada . |
| 1248829 | 1/1989 | Canada . |
| 1271101 | 7/1990 | Canada . |
| 1300992 | 5/1992 | Canada . |
| 2077126 | 8/1992 | Canada . |

*Primary Examiner*—Ira S. Lazarus
*Assistant Examiner*—David Lee
*Attorney, Agent, or Firm*—Roylance, Abrams, Berdo & Goodman, L.L.P.

[57] ABSTRACT

The present invention is directed to a sealed vent terminal assembly intended for use in association with high-efficiency oil fired furnaces or boilers. The terminal assembly of the present invention is designed to simultaneously flow outside combustion air to the furnace or boiler and eject combustion gases discharged from the furnace or boiler. It comprises a combustion gas vent pipe for receiving and axially ejecting the combustion gases, the combustion gas vent pipe having an open discharge end, a head chamber positioned over the open discharge end of the combustion gas vent pipe, the head chamber including a plurality of outlet ports and means for splitting and deflecting the combustion gases to the plurality of outlet ports, a combustion air inlet pipe colinearly disposed outwardly around the combustion gas vent pipe and defining an annular flow space operative to receive a flow of combustion air and a baffle disposed between the outlet ports of the head chamber and the annular flow space of the combustion air inlet pipe to inhibit the combustion gas from being mixed with the flow of combustion air. The terminal assembly of the present invention overcomes the difficulties of known devices as it operates effectively and efficiently in all wind conditions. The invention is further directed to a clamping system designed for use in association with the sealed vent terminal assembly.

17 Claims, 7 Drawing Sheets

BALANCED FLUE SEALED VENT TERMINAL ASSEMBLY

The present invention is directed to a balanced flue sealed vent terminal assembly and system for use with fuel fired combustion furnaces and heating appliances.

The venting assembly and system of the present invention is intended for use in association with a high-efficiency oil fired furnace or boiler. Such furnaces are now designed for installation and use without a chimney and to vent directly to the exterior of a building in which the furnace or boiler is installed.

BACKGROUND OF THE INVENTION

U.S. Pat. No. 5,282,456 (equivalent to Canadian Patent No. 2,077,126) describes a high efficiency induced draft condensing furnace with a horizontal plastic vent termination assembly. The termination vent assembly comprises a coaxial arrangement of a combustion gas vent pipe means for ejecting combustion gas discharged from the furnace and a combustion air inlet pipe means for drawing air in to assist with combustion. The combustion air inlet pipe means is concentrically disposed outwardly around the combustion gas vent pipe means. The discharge end of the combustion gas vent pipe means extends beyond the end of the combustion air inlet pipe means. It provides no means for baffling combustion gas or inlet air and does not take into account the effects of wind on the termination assembly.

Such coaxial arrangements of vent pipes and air inlet pipes are well-known in the trade.

SUMMARY OF THE INVENTION

The balanced flue sealed venting system of the present invention is a zero clearance, one piece terminal which mounts through an exterior wall. It is designed to exhaust flue gases away from the exterior wall and will also provide pre-heated combustion air for the operation of the furnace burner.

The terminal is designed to operate in a balanced flue mode which substantially maintains the pressure difference between combustion gases and combustion air thus allowing stable operation of the furnace even in extreme wind conditions.

The system is independent of the building air and isolates the heating system from the other building mechanical systems.

The present invention is directed to a horizontal vent terminal assembly for simultaneously flowing outside combustion air to a combustion device located within a dwelling having an exterior wall and ejecting combustion gases discharged from the combustion device to the outside of the dwelling, said horizontal vent termination assembly comprising:

(a) a combustion gas vent pipe for receiving and axially ejecting the combustion gases discharged from the combustion device, said combustion gas vent pipe having an open discharge end extending horizontally outwardly beyond an outside surface of the exterior wall;

(b) a head chamber positioned over the open discharge end of the combustion gas vent pipe, said head chamber including a plurality of outlet ports and means for splitting and deflecting the combustion gas travelling axially along the combustion gas vent pipe to the plurality of outlet ports;

(c) a combustion air inlet pipe colinearly disposed outwardly around the combustion gas vent pipe and defining therewith an annular flow space operative to receive a flow of the combustion air; and (d) a baffle disposed between the outlet ports of the head chamber and annular flow space of the combustion air inlet pipe to inhibit the combustion gas from being mixed with the flow of the combustion air.

The terminal assembly of the present invention will now be described in detail with reference to the accompanying drawings.

BRIEF DESCRIPTION OF THE DRAWINGS

Whenever possible like numerals have been used to designate like parts throughout the drawings.

DETAILED DESCRIPTION OF THE INVENTION

Figure 1:
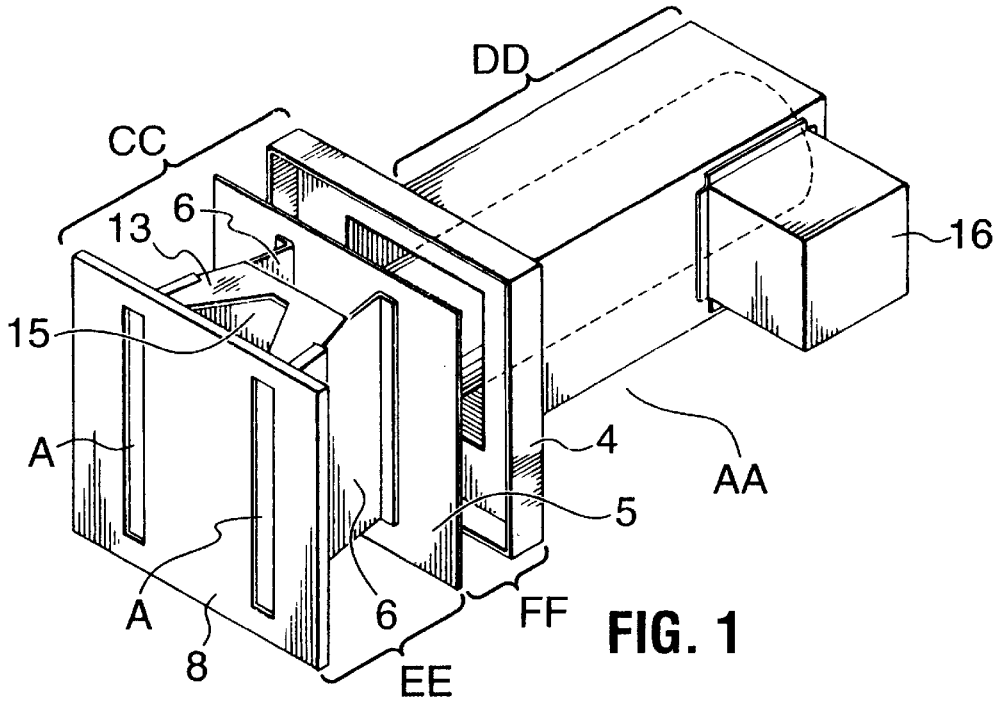
FIG. 1 is a perspective view of the terminal assembly.
Figure 2:
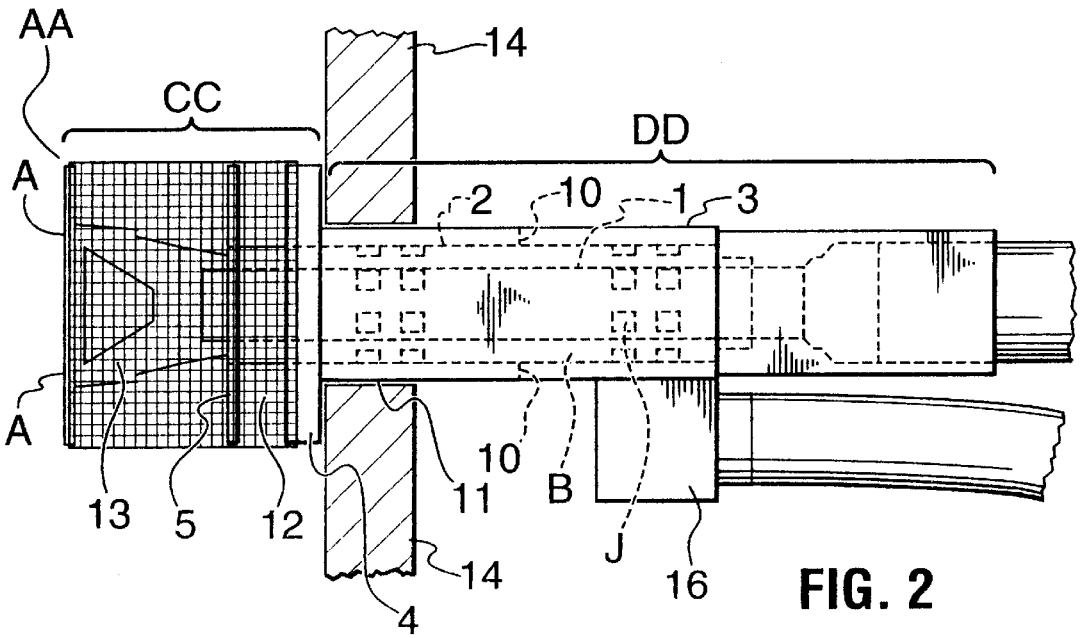
FIG. 2 is a top view of the terminal assembly and also shows the connection of the terminal assembly as it connects to the combustion gas vent connector pipe and the combustion air duct work of the furnace.
Figure 3:
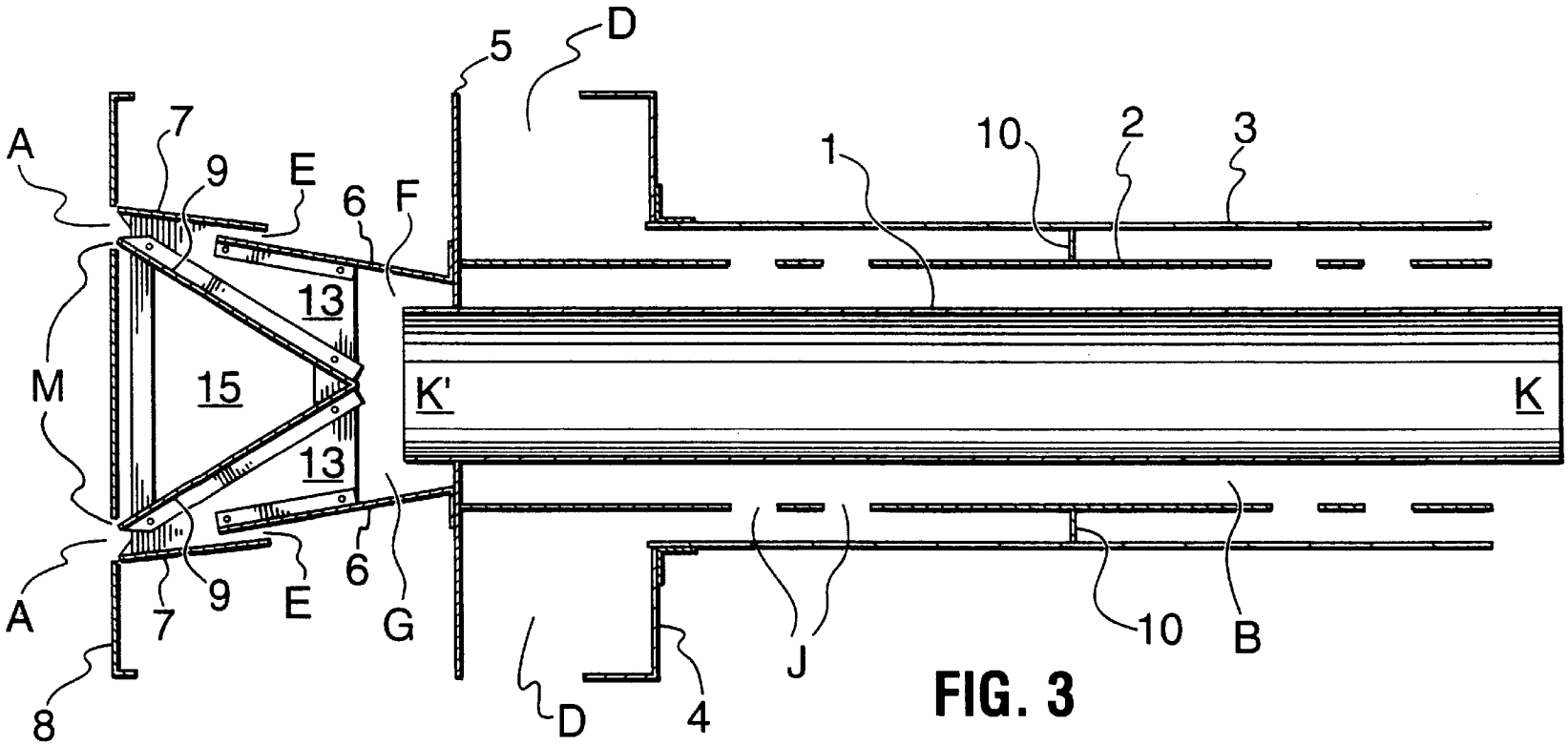
FIG. 3 is a top view showing the baffles, etc.
Figure 4:
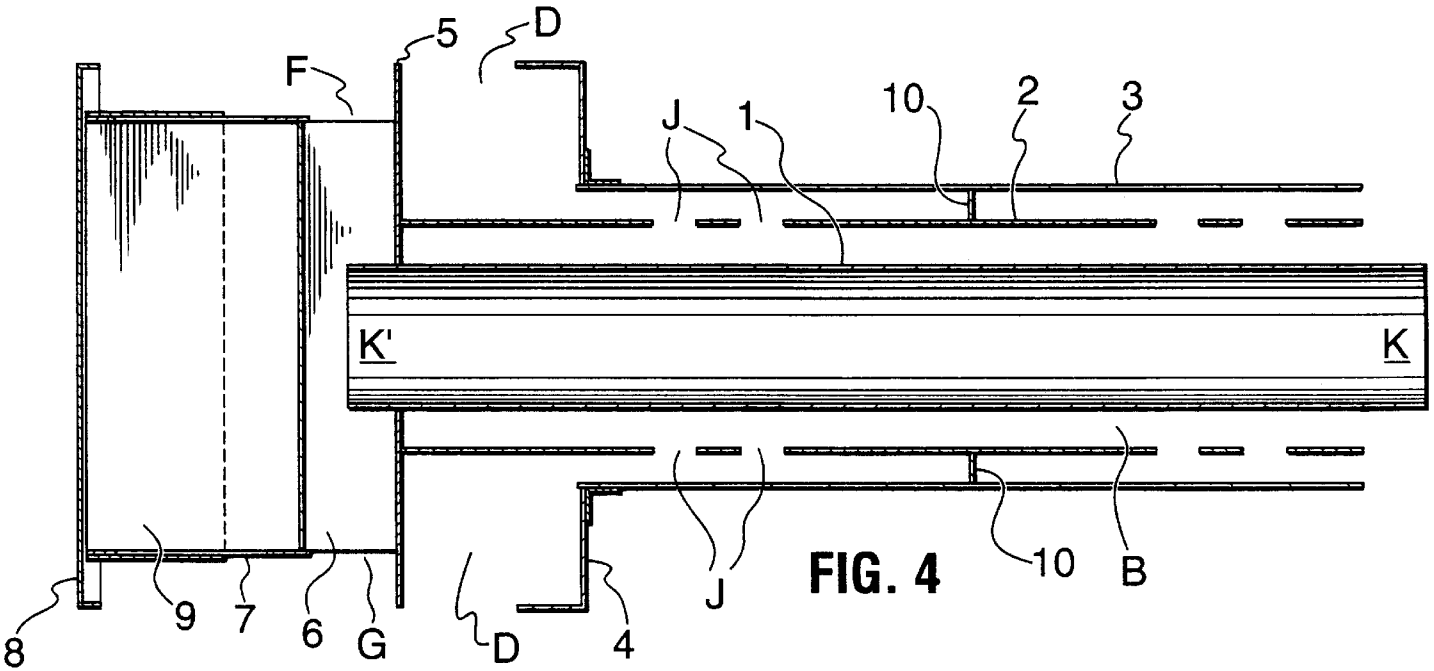
FIG. 4 is a side outline view showing the baffles, etc.
Figure 5:
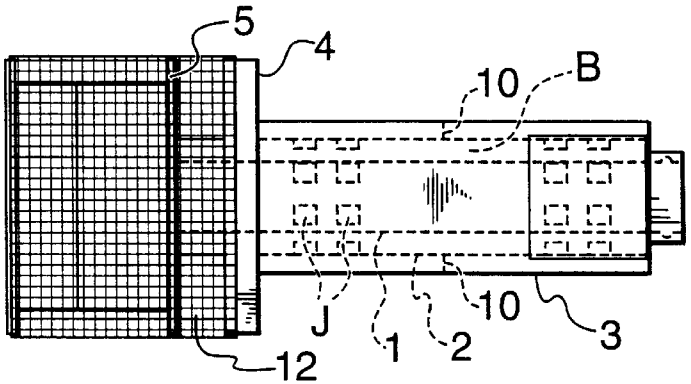
FIG. 5 is a side view of the terminal assembly.
Figure 6A:
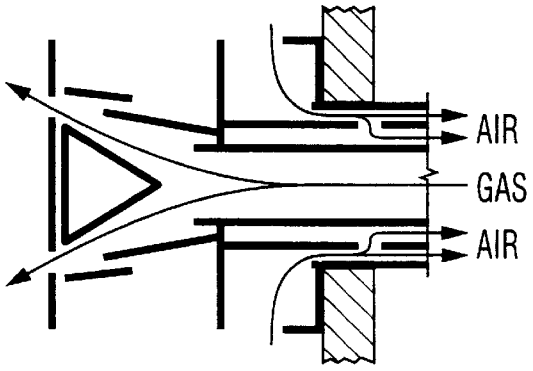
FIG. 6*a* is a top view outline diagram showing the effects of no wind on the terminal assembly of the present invention.
Figure 6B:
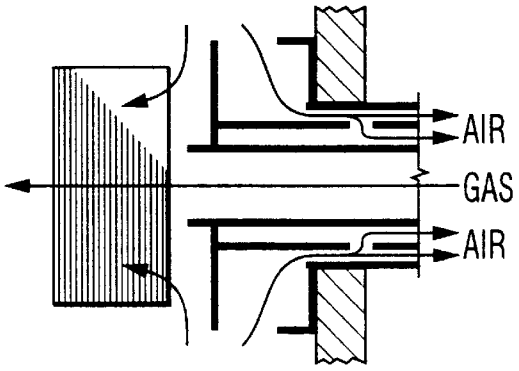
FIG. 6*b* is a side view outline diagram showing the effects of no wind on the terminal assembly of the present invention.
Figure 7A:
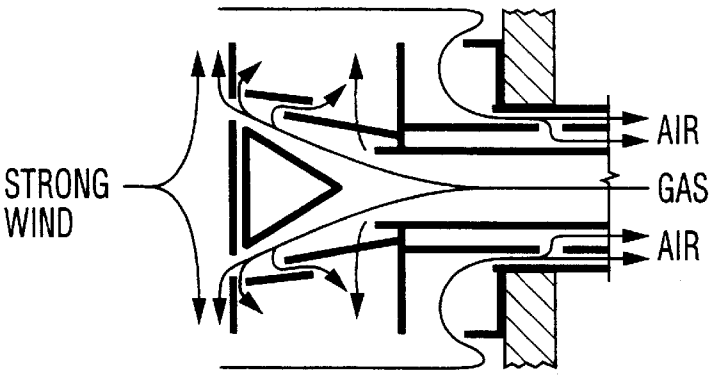
FIG. 7*a* is a top view outline diagram showing the effects of a strong wind normal to the wall.
Figure 7B:
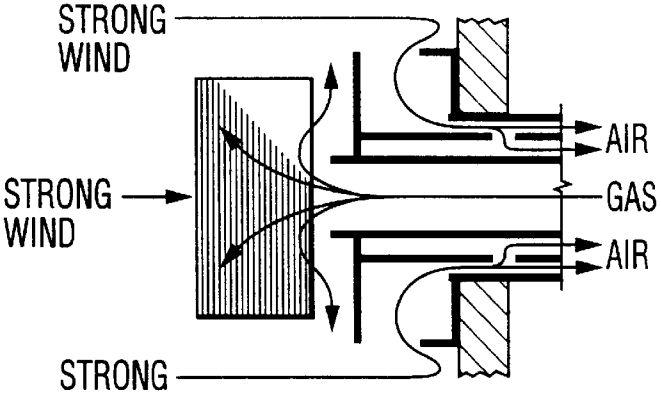
FIG. 7*b* is a side view outline diagram showing the effects of a strong wind normal to the wall.
Figure 8B:
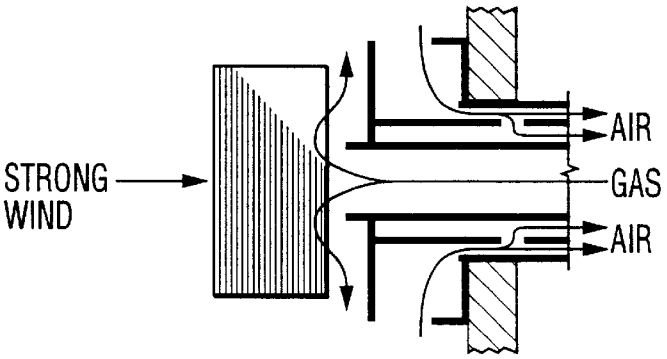
FIG. 8*b* is a side view outline diagram showing the effects of a strong wind at an angle of about 45° to the terminal assembly.
Figure 9B:
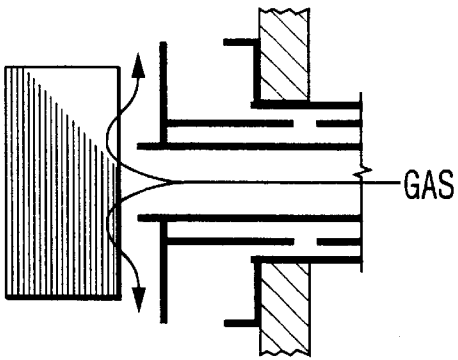
FIG. 9*b* is a side view outline diagram showing the effects of a strong wind along the wall.
Figure 8A:
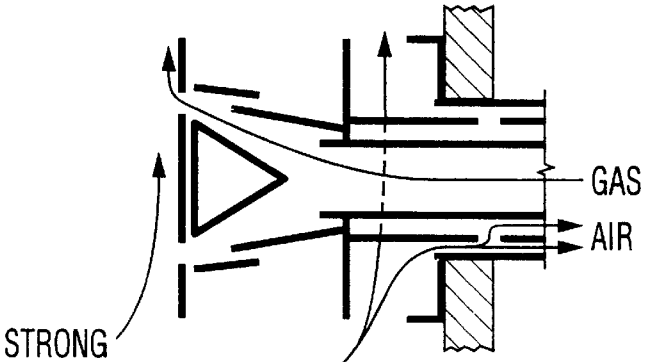
FIG. 8*a* is a top view outline diagram showing the effects of a strong wind at an angle of about 45° to the terminal assembly.
Figure 9A:
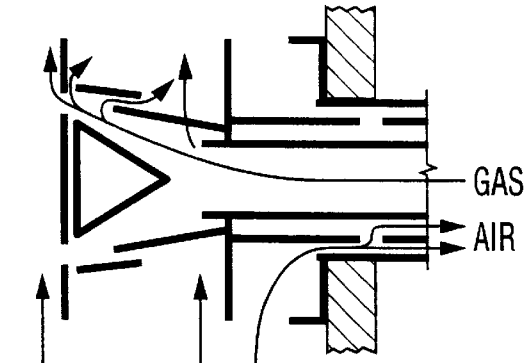
FIG. 9*a* is a top view outline diagram showing the effects of a strong wind along the wall.

As shown in FIGS. 1 and 2 the present invention provides a balanced flue sealed vent terminal assembly AA for use with a heating appliance, for example, an oil fired combustion furnace, boiler, water heater or similar appliance (not shown). The heating appliance is located in a building area near to an outside wall 14.

The terminal assembly AA comprises a terminal assembly outer head chamber CC that is located on the outside of wall 14 and an inner duct portion DD located through a hole 11 in the wall 14 and inside the building. The terminal assembly outer head chamber CC can be considered to comprise two sections. An outer combustion gas section EE located towards the front of the outer head chamber CC and an inner air inlet section FF located towards the rear of the outer head chamber CC. The inner section FF is located closest to the wall 14. The outer section EE and the inner section FF are separated from each other by a divider plate 5.

The inner duct portion DD comprises a vent pipe 1, a heat shield and pre-heat pipe 2 and an outer duct 3. The vent pipe 1 extends through the wall 14 to deliver combustion products from the furnace along an enclosed passage K to a point beyond air intake openings D (air inlet). The vent pipe 1 extends just beyond divider plate 5.

The vent pipe 1 is preferably round in cross section for uniform flow of the combustion gases and uniform heat loss characteristics. When the vent pipe 1 is round it easily fits and connects with the usually round flexible duct conveying the combustion gases from the furnace or other heating appliance. The vent pipe 1 is preferably constructed of stainless steel of low emissivity for corrosion resistance, for minimizing deposits and for reducing radiant heat transfer to the wall 14.

The heat shield and pre-heat pipe 2 surrounds the vent pipe 1 but does not extend beyond the end of vent pipe 1. The heat shield and pre-heat pipe 2 ends at divider plate 5 and sits flush against divider plate 5 such that the divider plate 5 closes the end of heat shield and pre-heat pipe 2 and separates the outer section EE from the inner section FF of the terminal assembly AA. Divider plate 5 further serves to separate the outer head chamber CC from the inner duct portion DD.

The heat shield and pre-heat pipe 2 prevents the heat from the vent pipe 1 from radiating to its surroundings. It does this by creating a cavity B around the vent pipe 1. The primary purpose of this heat shield and pre-heat pipe 2 is to shield the outer duct 3 from the radiant heat from the vent pipe 1 thus allowing the terminal assembly AA to be placed in direct contact with the combustible materials of the wall 14.

The heat shield and pre-heat pipe 2 is provided with air openings J and a partial baffle 10 positioned so that a proportion of the combustion air being drawn in along outer duct 3 through openings D, passes through cavity B and is diverted past the surface of vent pipe 1. The incoming combustion air is warmed as the vent pipe 1 is cooled by a convective heat transfer process. This raises the temperature of the combustion air in the outer duct 3.

The heat shield and pre-heat pipe 2 is generally round in cross section so as to provide uniform shielding and conveyance of the air inside it. The end of the heat shield and pre-heat pipe 2 is visible through the air inlet openings D where it meets divider plate 5. This allows the heat shield and pre-heat pipe 2 to act as an air inlet baffle when the wind is travelling along the plane of the wall 14. This will be described in more detail below. The diameter of the heat shield and pre-heat pipe 2 is such that under wind conditions it will provide a baffling effect to reduce pressure variations at the entry to outer duct 3 to counter balance the pressure effects induced in the combustion gas flow by the combustion gas heat shields 6, 7, 8, 9 and 13.

The heat shield and pre-heat pipe 2 is also preferably made of stainless steel of low emissivity for corrosion resistance and radiant heat transfer reduction.

The outer duct 3 surrounds both the vent pipe 1 and the heat shield and pre-heat pipe 2 and extends through the wall 14. It is shaped and bent to fit through the hole 11 in the wall 14 and extends around the hole 11 in all directions. The outer duct 3 is generally square in cross section and fits inside the square hole 11 through the wall 14. The outer duct 3 is made square to ensure that the terminal assembly AA is installed in and is maintained in its upright position. The outer duct 3 extends through and is attached to terminal head casing 4 at a slight angle to the exterior of the building so that any rainwater or melted snow accumulating in the outer head chamber CC will drain outwards.

The terminal assembly outer head chamber CC comprises a terminal head casing 4, a casing face 8, top and bottom covers 13, a plurality of heat shields 6 and 7, a splitter 9, and a wire screen mesh covering 12. Stainless steel L-shaped supports (not shown) extend from the terminal head casing 4 to the casing face 8 to provide the terminal assembly outer head chamber CC with stability. The wire screen mesh covering 12 surrounds the top, bottom and sides of the head chamber CC and is secured to the terminal head casing 4 and the casing face 8 with screws or other suitable fastening means.

The terminal head casing 4 is square and has a centrally located square hole to match with the hole 11 cut into the wall 14 and also to fit with the square outer duct 3. The terminal head casing 4 can be recessed up to 1 inch into any wall covering without blocking the air inlet openings D. The air inlet openings D are formed between the terminal head casing 4 and the divider plate 5.

The terminal head casing 4 is easily secured to the wall 14 with screws or other suitable fasteners. The terminal head casing 4 also serves to support the stainless steel wire mesh screen 12.

A divider plate 5 serves to divide the combustion gas section EE of the terminal head CC from the air inlet section FF. The divider plate 5 is generally square so as to match with the terminal head chamber CC. The divider plate 5 covers the end of heat shield and pre-heat pipe 2 to prevent the combustion gases from being drawn into the outer duct 3 and defines air inlet openings D on both sides, top and bottom of the terminal assembly outer head chamber CC.

Attached to divider plate 5 and located within the outer section EE of the terminal assembly outer head chamber CC are side shields 6 angled and positioned so that they shield the combustion gas outlet opening K' from the wind. The side shields 6 are angled away from the end of vent pipe 1 so that they do not constrict the flow of combustion gases as the gases spread over flow splitter 9. The side shields 6 extend vertically from the top cover 13 to the bottom cover 13 and are fixed to the covers 13. The splitter 9 extends to the same height as the side shields 6.

The side shields 7 serve a similar function as the side shields 6 but are offset at a slight angle from side shields 6 to form gap E. Under wind conditions gap E acts as a pressure release slot. If gap E is too small there is insufficient pressure relief. If gap E is too large there is too much pressure relief. The ends of side shields 6 and the ends of side shields 7 overlap slightly at gap E. The amount of overlap is not particularly important. Side shields 7 are secured to the top cover 13 and the bottom cover 13 and are positioned to provide back pressure relief through gap E from wind blowing normal to the terminal front casing face 8 and being forced through slot A. The side shields 7 are the same height as side shields 6 and splitter 9.

The passage between K' and slot A is partially covered over the top and bottom of splitter 9 by covers 13 to guide the combustion gases towards the slot A, leaving openings F and G to provide fresh air entrainment or pressure relief from the wind, depending on the wind conditions.

The terminal front casing face 8 is also square and provides two slots A. The terminal front casing 8 protects the inner head assembly from wind blowing directly at the wall 14. It deflects the wind and combustion gases flowing from slots A parallel to the wall 14 so that the combustion gases stay away from the air inlet openings D at the wall end of the terminal assembly AA. Terminal front casing face 8 also covers and prevents access to side shields 7 and the splitter 9 which are hot to the touch. The terminal front casing face 8 stays cool to the touch.

The combustion gas splitter 9 is V-shaped and has two inclined faces that split and spread the combustion gases expelled from opening K' of the vent pipe 1. The gases are spread both horizontally apart and vertically along the inclined faces of the splitter 9. They are baffled by the combined effect of the splitter 9, top and bottom covers 13 and shields 6 and 7 so that they usually flow through slots A. Some outside air is entrained through openings F and G to cool the effluent combustion gases. Splitter 9 is cooled by air which is free to flow through the triangular openings 15 located in top cover 13 and bottom cover 13. The splitter 9 is fixed to the top cover 13 and the bottom cover 13 and is of about the same size and shape as the triangular openings 15 in the top cover 13 and the bottom cover 13. Terminal front casing face 8 is set forward of the splitter 9 to prevent external contact with splitter 9.

A ring shaped partial baffle 10 surrounds the heat shield and pre-heat pipe 2 part way along its length. It is considered a partial baffle because it is round but is located inside the square outer duct 3. The corner space between the baffle 10 and the outer duct 3 allows some combustion air to be drawn in towards the burner. The presence of the baffle 10 encourages some air to travel inside the heat shield and pre-heat pipe 2 through the openings J at either end of it.

The sides, top and bottom of the terminal assembly head are covered with a stainless steel wire mesh screen 12. It does not cover the front of the casing or the two slots A. The front of the terminal assembly head is covered with front casing face 8. The screen prevents insects and other animals or birds from entering the combustion air inlet openings D and also prevents contact with the hot parts of the shields 6 and 7 and the splitter 9.

The top and bottom of the shields 6 and 7 and the splitter 9 are covered by top and bottom covers 13 to direct the combustion gases towards the slots A. The covers 13 have triangular openings 15 cut in the top and the bottom through which heat from the inside of the combustion gas splitter 9 can disperse.

The arrangement of the heat shields 6 and 7 and the splitter 9 is designed to minimize pressure variations on combustion gas outlet K' associated with wind and wind direction. The wall 14 will redirect wind along its face. The wind flow that is parallel to the face of the wall 14 strikes the heat shields 6 and 7 and the covers 13 in such a manner that the pressure variations due to the wind on the combustion gas flow and the pressure variations due to the wind on the combustion air inlet flow are substantially balanced against each other. The component of wind flow that is normal to the wall 14 is turned to flow parallel to the wall 14. The consequent increase in static pressure experienced by the combustion air inlet openings D at the wall counterbalances the velocity pressure experienced through the slots A by the combustion gas outlet K'. The pressure effect of the component of the wind flow through slots A which is normal to the casing face 8 is relieved by top and bottom slots F and G in cover 13 and gaps E between side shields 6 and 7.

In a low wind or no wind situation the combustion gases leave the terminal through slots A. If the component of the wind velocity normal to the casing face 8 increases, the flow through these slots reverses, the combustion gases disperse through the steel mesh screen 12, and the slots A relieve the pressure due to head-on wind.

The gap M is a conduction break that prevents the heat from the shield assembly 7, 9 and 13 from being conducted to the face of casing 8.

The vertical side slot or gap E situated between side shields 6 and 7 is positioned to relieve pressure from wind normal to the terminal casing face 8 on the exit point K' of the vent pipe 1.

The combustion air inlet openings D are present on the top, bottom and sides near to the rear part DD of the terminal assembly AA. They permit combustion air to be drawn into the terminal assembly AA prior to its travelling through the wall 14 and along the outer duct 3 to the furnace burner (not shown). The air inlet openings D are covered by the wire mesh screen 12 to prevent insects and other animals or birds from entering.

For calm wind conditions a passage F is located at the top of the terminal assembly AA to entrain air for the combustion gases leaving the vent pipe 1 at exit K'. Under head-on wind conditions it acts as a pressure relief for the shield assembly preventing the build up of static pressure at K'.

A shield assembly bottom opening G similar to F is provided but entrains more outside air than F because the hot combustion gases tend to rise away from it due to buoyancy.

The openings J provide entry for some combustion air to travel through heat shield and pre-heat pipe 2 to reduce the temperature of the passage between vent pipe 1 and heat shield and pre-heat pipe 2.

Referring to FIGS. 7*a*, 7*b*, 8*a*, 8*b*, 9*a*, 9*b*, 10*a* and 10*b* we will now describe the effect of wind on the terminal assembly of the present invention.

In a no wind situation the flow of combustion gases leaves the vent pipe 1 at K' and is split by the splitter 9. Cool outside dilution air which reduces the combustion gas temperature is entrained through openings E, F and G and the air/gas mixture is guided by shields 6 and 7 out through slots A. The combustion air is drawn in through all four of openings D, that is, from the top, the bottom and the sides of section FF of the terminal assembly AA. Some of this air travels into the space between the vent pipe 1 and the heat shield and pre-heat pipe 2. The pressure difference between D and K is maintained at a substantially constant balance.

In a situation where a strong wind blows horizontally or normal to the wall, i.e. head-on to the wall, wind will blow through front slots A and will force the combustion gas being blown out of K' back through slots M, E, F and G. The back pressure on K' is increased. The wind strikes the wall 14 and pressurizes the combustion air inlet openings D. The pressure difference is maintained substantially in balance by the pressure at D from the stalled wind and the pressure at K', which is relieved by the slots M, E, F and G.

The horizontal component of a strong wind blowing parallel to the wall strikes shields 6 and 7 creating a slight vacuum behind them. Some combustion gas leaves at slots A and some gas is drawn away by the presence of shields 6 and 7 out of slots M and E and the top and bottom openings F and G. Wind enters through the windward air inlet opening D and leaves through the leeward air inlet opening D. It strikes the outer surface of heat shield and pre-heat pipe 2 and some combustion air is diverted into the passages between pipes 1 and 2 and between pipe 2 and duct 3. The pressure difference is maintained substantially in balance because the change in pressure due to the flow around the shields 6 and 7 is substantially matched by the change in pressure due to the air flow due to the wind through the side air inlet openings D. The latter pressure is modified by the baffling effect of the heat shield and pre-heat pipe 2. Thus the pressure difference is substantially balanced.

Installation of the balanced flue sealed vent terminal assembly will now be described briefly. The sealed vent terminal assembly of the present invention has been designed specifically for, but not restricted to, use in association with oil fired warm air furnaces and in association with oil fired hot water boiler appliances.

Figure 10:
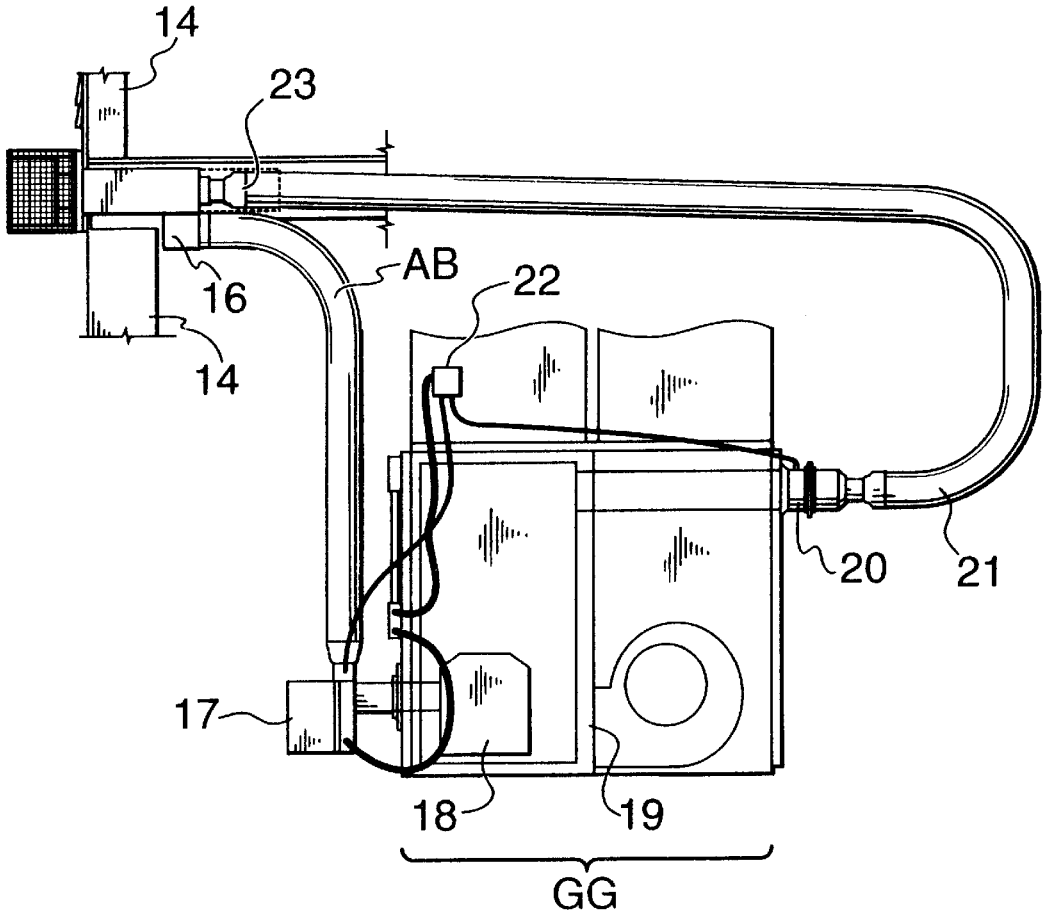
FIG. 10 shows a typical installation of the sealed vent terminal assembly of the present invention with a combustion furnace.

Combustion air is drawn through air intake openings D along cavity B into air take-off box 16 of FIG. 2 along duct AB of FIG. 10 into the burner 17. The air take-off box 16 can be installed on either side of the terminal assembly AA or on the bottom. This allows the installer to match the installation to the conditions encountered at the installation site. The burner 17 consists of an electrically powered combustion air blower which draws the combustion air through the terminal assembly AA as described above and mixes it with an oil spray inside the combustion chamber of the furnace GG, produced by an electrically powered oil pump which pumps oil into the combustion chamber through a spray nozzle. The spray nozzle changes the oil into a fine particulate spray. An electric igniter starts the fire. The burner also includes an integral internal electronic safety control that stops the burner if there is no fire in the combustion chamber 18. The oil spray burns inside the combustion chamber 18 and the hot gaseous combustion products move through the heat exchanger 19 to breech 20.

A blockage sensor 22 shuts off the burner if the air inlet or the combustion gas outlet duct is partially or totally blocked. The blockage sensor 22 senses the difference in pressure between the combustion air being drawn through the air duct AB into the burner at 17 and the combustion gas in the vent pipe 21 at the breech 20. Much testing has been conducted to establish an average maximum differential pressure at which satisfactory operation of the burner ceases. A single differential pressure setting has been established which works for vent and air duct lengths up to 7.5 meters (25 feet) and for the specified vent pipe diameters of 4, 5 and 6 inch used for burner oil input rates from 1.9 to 5.7 liters/hour (0.5 to 1.5 USGPH (United States gallons per hour)). When the differential pressure rises above a predetermined value the blockage sensor 22 will stop the burner. The burner will not restart until the blockage is cleared.

The hot combustion gases pass through the heat exchanger 19 on their way from the combustion chamber 18 to breech 20. The heat exchanger 19 transfers the heat to a distribution medium, commonly air in the case of a furnace, or water in the case of a boiler or water heater.

The furnace includes a circulating blower assembly and functions in the same manner as any forced warm air heating furnace drawing cold air from living areas and distributing it warmed throughout the distribution duct work. Similarly, the boiler includes a circulatory system which functions to distribute the heated water to a heat distribution system.

The terminal assembly AA can also be used with a conventional hot water boiler appliance and installation is similar to that described with respect to the furnace.

The vent pipe 21 as seen in FIG. 10 is a double walled insulated flexible vent pipe that runs from the breech 20 to the terminal adaptor 23. The vent pipe 21 conveys the cooled combustion gases from the appliance breech 20 to the sealed vent terminal assembly AA and is attached to the appliance breech 20 by an improved clamping system comprising a mechanical screw clamp 24 with a re-usable ring seal or O-ring 25. A similar smaller seal clamp and ring seal are used to secure the terminal adaptor 23 to the terminal vent pipe 1. This requires that the pipe coming from the breech and the vent pipe be fashioned in such a manner to accept the clamp and the seal. The combined mechanical screw clamp and re-usable seal allow easy and quick access to the vent system for cleaning and inspection thus avoiding the use of caulking or sealant.

When a furnace or hot water boiler is vented through a conventional chimney the connection between the breech and the chimney is typically made by means of an unsealed slip-on pipe that is secured with a single screw or multiple screws through both the breech and the vent or chimney pipe. Other direct vent systems which are pressurized have a similar joint which is caulked by the installer with a high temperature sealant. When the vent pipe joint must be opened for cleaning and inspection the seal must be broken, cleaned off and then re-caulked to restore it to its original condition.

As mentioned above, the clamping system of the present invention is an improvement over that known in the art. It will now be described in more detail with reference to FIGS. 11*a*, 11*b*, 11*c*, 11*d* and 11*e*.

The clamping system of the present invention comprises a mechanical seal clamp 24, an inner rolled channel 31 and a ring seal or O-ring 25. The mechanical seal clamp 24 is a flat, flexible strap that wraps around the outside of the pipes to be held together. A separate inner rolled channel 31 fits between the pipe and the mechanical seal clamp 24. The mechanical seal clamp 24 and inner rolled channel 31 are sized to fit pipes of various diameters. The mechanical seal clamp 24 is secured and tightened by a standard worm screw 26.

Figure 11A:
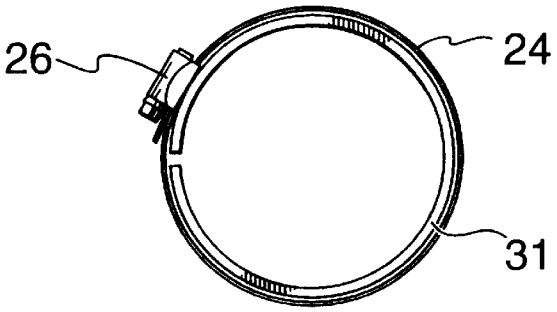
FIG. 11*a* shows a mechanical seal clamp.
Figure 11B:
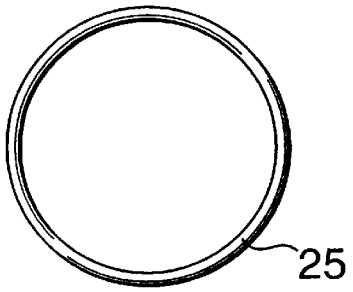
FIG. 11*b* shows a ring seal or O-ring suitable for use with the mechanical seal clamp.
Figure 11C:
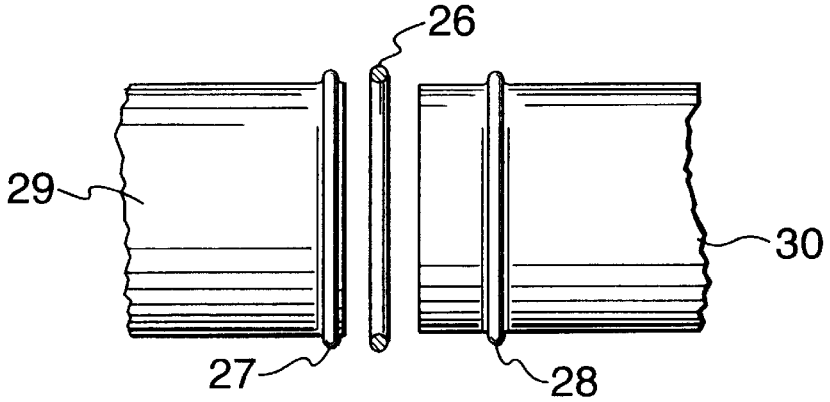
FIG. 11*c* shows the manner in which the mechanical seal and ring seal or O-ring are used to connect two pipes.
Figure 11D:
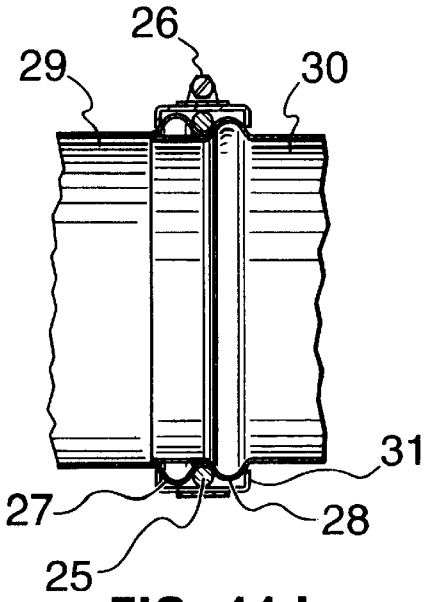
FIG. 11*d* shows the fully assembled unit.
Figure 11E:
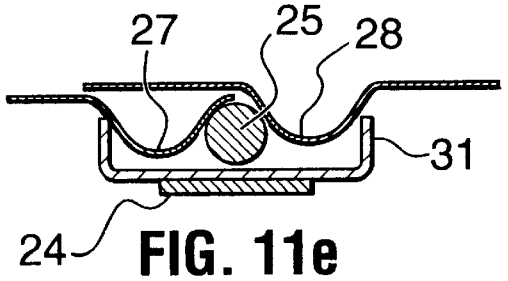
FIG. 11*e* shows a close-up enlarged view of the fully assembled unit.

The pipes to be held together, for example, vent pipe 21 to breech 20 or vent pipe 1 to terminal adaptor 23, are generally of seamless construction. One must be slightly smaller in diameter than the other so that one will slide inside the other. Rolled beads 27 and 28 are formed in the pipes. The rolled bead on one is formed as close to the end of the pipe as possible while the other is formed at a specified distance from the end of the pipe. This distance is determined such that sufficient length of one pipe slides beyond the bead of the other. As shown in FIG. 11*c*, pipe 29 has the bead formed near to the end of the pipe while pipe 30 has the bead formed a predetermined distance in from the end of the pipe. The pipe 30 with the bead spaced beyond the end of the pipe slides into the pipe 29 with the bead near the end of the pipe. The ring seal or O-ring 25 is placed on the end of pipe 30, close to the rolled beads.

The mechanical seal clamp 24 is tightened by tightening worm screw 26 so that the inner rolled channel 31 is forced into contact with the sloping surfaces of beads 27 and 28 on the two mated pipes 29 and 30. The gripping action of the inner rolled channel 31 slides the mated pipes towards one another along the same axis and brings the beads 27 and 28 axially closer together. At this same time the inner surface of the inner rolled channel 31 moves in a radial direction closer to the axis of the pipes. The ring seal or O-ring 25 is compressed in the space between the two beads 27 and 28 and the inner rolled channel 31. When all the parts are appropriately dimensioned the ring seal or O-ring 25 is wedged between the three surfaces around the entirety of the mated pipes and seals the rolled beads 27 and 28 against the escape of gas. The pipe joint is simultaneously sealed and clamped.

As described above the joint can be easily taken apart for inspection and cleaning. No sealing or caulking compounds are needed and the clamping system including the ring seal or O-ring is re-usable.

The sealed vent terminal assembly of the present invention operates efficiently and without problems in all wind conditions. It is designed to overcome the problems associated with known coaxial sealed vent systems.

The clamping system of the present invention provides operable joints for easy access to the vent pipes and duct work of the sealed vent system. It is re-usable and cost effective.

What is claimed is:

1. A horizontal vent terminal assembly for simultaneously flowing outside combustion air to a combustion device located within a dwelling having an exterior wall and ejecting combustion gases discharged from the combustion device to the outside of the dwelling, said horizontal vent terminal assembly comprising:

(a) a combustion gas vent pipe for receiving and axially ejecting combustion gases discharged from a combustion device, said combustion gas vent pipe having an open discharge end extending horizontally outwardly beyond an outside surface of an exterior wall;

(b) a head chamber positioned over said open discharge end of said combustion gas vent pipe, said head chamber including a plurality of outlet ports and splitting means for splitting and deflecting combustion gas travelling axially along said combustion gas vent pipe to said plurality of outlet ports, said splitting means having an inner end adjacent said discharge end of said vent pipe and an outer end spaced from said inner end, a pair of first side shields coupled to said splitting means, each of said first side shields having an inner end and an outer end said outer end being spaced from said outer end of said splitting means, and a pair of second side shields, each of said second side shields being spaced from a respective first side shield and having a first end overlying said outer end of said first side shield to form a gap and a second end spaced from said outer end of said splitting means to form said outlet ports;

(c) a combustion air inlet pipe colinearly disposed outwardly around said combustion gas vent pipe and defining therewith an annular flow space operative to receive a flow of combustion air, said inlet pipe having an inlet end and an outlet end; and (d) a baffle disposed between said outlet ports of said head chamber and annular flow space of said combustion air inlet pipe to inhibit combustion gas from being mixed with a flow of combustion air into said air inlet pipe.

2. A horizontal vent terminal assembly according to claim 1 wherein the means for splitting and deflecting combustion gas is a v-shaped splitter having a top and a bottom.

3. A horizontal vent terminal assembly according to claim 2 wherein the splitter is partially covered on the top and the bottom.

4. A horizontal vent terminal assembly according to claim 1 wherein the baffle is a divider plate.

5. A horizontal vent terminal assembly according to claim 1 wherein said first and second shields form heat shields.

6. A horizontal vent terminal assembly according to claim 1 wherein said side shields are arranged in such a manner so as not to constrict the flow of the combustion gases.

7. A horizontal vent terminal assembly according to claim 1 wherein said gap between said first and second side shields are arranged in such a manner to define a pressure release slot.

8. A horizontal vent terminal assembly according to claim 1 wherein the head chamber is covered with a mesh screen.

9. The horizontal vent assembly of claim 2, wherein said splitting means has an apex spaced from said discharge end of said combustion gas vent pipe, a top plate coupled to said top of said splitting means and spaced from said baffle to define a first air inlet into said head chamber, and a bottom plate coupled to said bottom of said splitting means and spaced from said baffle to define a second air inlet into said head chamber.

10. The horizontal vent assembly of claim 9, wherein said top and bottom plates each have an inner edge adjacent said apex and an outer edge adjacent said outer end of said splitting means.

11. The horizontal vent assembly of claim 9, wherein said top and bottom plates are in a plane substantially perpendicular to said side shields.

12. The horizontal vent assembly of claim 1, further comprising an end shield coupled to said head chamber and having openings at said second outlet ports, said end shield extending in a plane substantially perpendicular to an axis of said combustion gas vent pipe, said end shield extending outwardly from said head chamber parallel to said baffle.

13. The horizontal vent assembly of claim 1, further comprising a heat shield disposed in said air inlet pipe between said air inlet pipe and said vent pipe, said heat shield surrounding said vent pipe and having a first end coupled to said baffle and a plurality of openings to allow air to pass through said heat shield.

14. The horizontal vent assembly of claim 13, further comprising at least one baffle between said heat shield and said inlet pipe.

15. The horizontal vent assembly of claim 13, wherein said air inlet pipe has a side wall with an air inlet at a first end adjacent said baffle and an air outlet at a second end.

16. The horizontal vent assembly of claim 1, wherein said first side shields extend at an angle away from said vent pipe.

17. The horizontal vent assembly of claim 1, wherein said inner end of each of said first side shields is coupled to said baffle.

* * * * *